US008307670B2

(12) United States Patent
Stewart et al.

(10) Patent No.: US 8,307,670 B2
(45) Date of Patent: Nov. 13, 2012

(54) ICE HOLDING DEVICE

(76) Inventors: Anna M Stewart, Naples, NY (US); Stephen Kraigh Stewart, Naples, NY (US)

( * ) Notice: Subject to any disclaimer, the term of this patent is extended or adjusted under 35 U.S.C. 154(b) by 0 days.

(21) Appl. No.: 12/949,943

(22) Filed: Nov. 19, 2010

(65) Prior Publication Data

US 2011/0061421 A1 Mar. 17, 2011

Related U.S. Application Data

(63) Continuation of application No. 11/530,754, filed on Sep. 11, 2006, now abandoned, which is a continuation-in-part of application No. 29/255,661, filed on Mar. 11, 2006, now Pat. No. Des. 536,932.

(51) Int. Cl.

| | |
|---|---|
| ***F25D 3/08*** | (2006.01) |
| ***F25D 3/02*** | (2006.01) |
| ***B65D 21/00*** | (2006.01) |
| ***B65D 85/00*** | (2006.01) |
| ***B22D 27/04*** | (2006.01) |

(52) U.S. Cl. ..... 62/457.2; 62/459; 206/509; 206/515; 220/521; 249/81

(58) Field of Classification Search ..... 62/457.2, 62/459; 220/739, 921

See application file for complete search history.

(56) References Cited

U.S. PATENT DOCUMENTS

| | | | | |
|---|---|---|---|---|
| 1,026,154 | A * | 5/1912 | Doughty | 312/31 |
| 2,152,019 | A * | 3/1939 | Bates | 62/530 |
| 3,700,204 | A | 10/1972 | Swett et al. | |
| 3,776,504 | A | 12/1973 | Wiley | |
| 3,802,220 | A * | 4/1974 | Pompo | 62/530 |
| 4,671,424 | A * | 6/1987 | Byrns | 220/592.16 |
| 4,883,251 | A | 11/1989 | Manas | |
| 5,551,592 | A | 9/1996 | Barton et al. | |
| 7,337,915 | B1 | 3/2008 | Weldon | |
| 2003/0070447 | A1 * | 4/2003 | Tanaka | 62/457.4 |

* cited by examiner

*Primary Examiner* — Marc Norman
*Assistant Examiner* — Filip Zec
(74) *Attorney, Agent, or Firm* — Smith Risley Tempel Santos LLC; Gregory Scott Smith

(57) ABSTRACT

A multi-purpose ice holding assembly is disclosed for the making and storing of ice. Parts of the assembly include an external chamber, a bucket that inserts snugly into the external chamber and a lid for closing the assembly. Pockets for the forming of ice may be formed in the external chamber or the internal bucket, depending on the embodiment. The device may also be used for the serving of ice, as well as the chilling of wine bottles and other cold beverage containers.

1 Claim, 4 Drawing Sheets

ICE HOLDING DEVICE

CROSS-REFERENCE TO RELATED APPLICATIONS

This application is a continuation of the U.S. patent application filed on Sep. 11, 2006 and assigned Ser. No. 11/530,754, which application claims the benefit of the filing date of and is a continuation-in-part of U.S. Design patent application having a title of ICE HOLDING 5 DEVICE, filed on Mar. 11, 2006 and assigned serial number 29/255,661.

BACKGROUND

The present invention relates to the field of ice holding devices, and more particularly to multi-purpose ice forming assemblies.

Conventional ice trays generally suffer from several endemic problems. Some of these problems include the following.

The first problem pertains to the filling of conventional ice trays to achieve level filling of each ice compartment. The second problem pertains to the transporting of a filled ice tray to a freezer without spilling water during transport. The third problem pertains to the placing of an ice tray in a freezer without spilling water. The fourth problem pertains to the lack of levelness of a freezer, which may result in non-uniform sized cubes. The fifth problem pertains to the tendency of ice cubes to go stale due to absorbing odors from other foods. The sixth problem pertains to the cubes being exposed to air and evaporating. Other problems exist.

Previous attempts to solve some of these problems include the following. One solution involved the creation of a bottle style ice tray. This method allows the user to fill a bottle with a desired liquid to an indication line on the bottle, to cap the bottle and to place the bottle in the freezer. While this is a simple and easy to understand approach the design has several problems. The first problem is that if the device was slightly over-filled the cubes would overflow the ice separation walls and freeze into one block of ice, thus making it nearly impossible to extract the ice. The other major flaw is the type of material traditionally used in fabricating the bottle is non-flexible and breaks quite easily.

A second solution involved using a sliding lid that is connected to an ice tray and pushed over the ice compartments once they were filled. While this accomplished the covering of the ice for transportation and prevents the evaporation of the ice once the device is placed in the freezer, sliding the lid is difficult and spillage frequently occurs before the tray is moved.

Known art related to an ice holding device includes the following.

U.S. Pat. No. 1,896,849, issued to Newman on Feb. 7, 1933, discloses a freezing tray with a cover.

U.S. Pat. No. 2,604,579, issued to Deneboudes on Jul. 22, 1952, discloses an ice bucket having a double wall and transparent or trans-lucid windows so that light can illuminate ice held within the ice bucket.

U.S. Pat. No. 3,670,523, issued to Fogt et al. on Jun. 20, 1972, discloses a resilient plastic ice tray and integral grid formed by a longitudinal center partition having an inverted V-shaped cross section together with transverse partitions enclosing two rows of freezing compartments. The tray center partition being of greater height than its transverse partitions, end walls and side walls to allow complementary notched locking guides formed on the underside thereof to cooperate with the upstanding rib portion of the central partition of an underlying tray for relative sliding movement therebetween and to support the trays in interlocked nested fashion when the trays are stacked one upon another in vertically aligned relation. Each tray has its side and end walls provided with an outwardly extending flange wall which allows a tray with its frozen contents to be inverted and nested over a receiving container having a cooperating outwardly directed seating ledge about its upper open end to harvest ice cubes into the container while the container additionally provides for a tray to be nested in an upright position either over or under the container.

U.S. Pat. No. 4,081,122, issued to Hobson on Mar. 28, 1978, discloses a carton of a suitable protective flexible plastic or plastic coated material includes a plurality of ovoid cavities for receiving eggs, each cavity having a plurality of communicating channels with tapered sides. The material provides a waterproof base to permit further use of the egg carton as an ice tray. The channels permit water flow between adjacent cavities and provide stress points to facilitate separation and removal of ice cubes formed in the cavities.

U.S. Pat. No. D249,269, issued to Pitts on Sep. 5, 1978, illustrates an ice tray for making spherical ice cubes.

U.S. Pat. No. 262,355, issued to Oakley on Dec. 22, 1981, illustrates a combined egg carton and ice tray.

U.S. Pat. No. D292,802, issued to Fails on Nov. 17, 1987, illustrates an ice cube tray for making half-spheroid ice cubes.

U.S. Pat. No. D352,045, issued to Daemen et al. on Nov. 1, 1994, illustrates an ice cube tray and dispenser.

U.S. Pat. No. D431,754, issued to Thuma on Oct. 10, 2000, illustrates an ice bucket with apparent moisture escape slits.

U.S. Pat. No. D483,620, issued to Basara on Dec. 16, 2003, illustrates an ice bucket having a bucket, lid, and liner.

U.S. Pat. No. 7,014,162, issued to Lion et al. on Mar. 21, 2006, discloses an ice cube tray having a rigid support structure for easy handling and manipulation includes plural ice cube compartments, the ice cube compartments including deformable, flexible bottoms to enable ejection of ice cubes by application of a small force on each ice cube compartment's bottom. The tray may be used with a cover that can be utilized as a server. The tray when used with the cover is spill proof. To use as a server, the tray and cover are turned upside down, the ice cubes are ejected by applying force to the flexible bottoms of the ice cube compartments. Once ejected, the tray is removed to reveal the ejected ice cubes within the underside of the cover. Multiple ice cube trays can be stacked on top of the cover While these devices fulfill their respective, particular objectives and requirements, the aforementioned patents do not utilize or disclose an ice holding device that can serve as an ice tray, an ice bucket and a beverage cooler in the manner of the present invention.

Therefore, a need exists for an ice holding device with these attributes and functionalities. The ice holding device according to embodiments of the invention substantially departs from the conventional concepts and designs of the prior art. It can be appreciated that there exists a continuing need for a new and improved ice holding device which can be used commercially. In this regard, the present invention substantially fulfills these objectives.

The foregoing patent and other information reflect the state of the art of which the inventors are aware and are tendered with a view toward discharging the inventors' acknowledged duty of candor in disclosing information that may be pertinent to the patentability of the present invention. It is respectfully stipulated, however, that the foregoing patent and other information do not teach or render obvious, singly or when considered in combination, the inventors' claimed invention.

BRIEF SUMMARY

The present invention makes and stores ice after being equipped and placed in a freezer; it also provides for the serving of ice as well as the chilling of liquids contained in bottles or cans that are placed therein.

In an exemplary embodiment the present invention is comprised of an exterior chamber, an interior damming bucket and a lid. The exterior chamber may be comprised of a fill-line or fill indicator disposed on the inside of the exterior chamber. The exterior chamber may be further comprised of an array of cavities, i.e. ice molding pockets, formed on the inside of the exterior chamber where these cavities form an array of protrusions on the outside of the exterior chamber. Channels, i.e. gates and runners, may connect these cavities. The damming bucket is dimensioned to fit snuggly inside the exterior chamber and to allow sealing of the exterior chamber when the damming bucket is inserted within the exterior chamber. The lid is dimensioned to fit snuggly on top of the exterior chamber. The lid facilitates ice staying fresh and not evaporating in the freezer.

The making of ice using the present invention is accomplished by filling the exterior chamber with water, or another desired liquid, to the level of the fill indicator. The damming bucket is then placed inside the exterior chamber, which displaces the liquid into the cavities in the exterior chamber. Any excess liquid overflows out of the exterior chamber. The damming bucket remains within the exterior chamber, the lid is placed on top of this assembly, and the entire assembly is placed inside a freezer to solidify the liquids within the cavities. Once the liquid within the cavities is frozen, the damming bucket is removed from the exterior chamber and ice within the recesses is removed by flexing the external chamber. The removed ice may then be placed inside the damming bucket and the exterior chamber may be refilled if desired, the damming bucket replaced inside chamber, the lid placed on top of the assembly and the entire assembly placed back in the freezer to make more ice. In addition to making and storing ice in a freezer, another use of the present invention may be to use it as an ice bucket and for the serving of ice.

An optional procedure is to leave the ice formed by the above process inside the molding pockets in the exterior chamber and to place a container of wine or other liquid inside the exterior chamber for chilling.

The present invention departs from the prior art by not having a tray style design. The design of the present invention is inspired from injection molding methods, rotational casting methods and from the field of hydraulics. Inside any molding tool are a series of runners and gates that carry molten or liquid materials to the cavity that creates the molded part. The present invention uses similar types of gates and runners to connect the cavities in order to ensure that each cavity is adequately filled every time. Overfilling of the cavities cannot occur because the damming bucket forces out the excess liquid hydraulically. The result is ice that cannot become stuck and is substantially uniform in shape.

Secondly, once the cavities are full and the damming bucket is in place liquid is not spilled during transport of the assembly to a freezer. Another feature of this approach is that the ice is completely encapsulated and does not spill during placement of the assembly into a freezer.

Thirdly, with the lid in place any ice contained in the bucket portion is stored without absorbing food odors or evaporating. Another feature is the easy removal of the ice due to the flexibility of the external chamber.

The present invention also departs from the prior art by having the ability to store ice while additional ice is being formed. No other known device facilitates the serving of ice from the same apparatus in which the ice is made in the manner of the present invention. This feature adds to the usefulness of the present invention by saving space and eliminating the need for an additional conventional ice bucket and trays.

Yet another feature of the present invention is the ability to chill other liquids contained in bottles or cans by placing them into the damming bucket or inside the exterior chamber with ice either in the recesses, in the damming bucket, or both.

In one embodiment of the present invention the damming bucket may have cavities indented on its surface pointing inward while the exterior chamber does not have cavities but is dimensioned to fit snuggly around the damming bucket. This embodiment may be further comprised of gates and runners connecting the cavities.

One aspect of the present invention is that it may be used to function as an ice bucket for the serving of ice.

Another aspect of the present invention is that it may be used to chill bottled or canned liquids.

Another aspect of the present invention is that the amount of ice that can be made is greater than the amount of ice created by a conventional ice tray.

Another aspect of the present invention is the creation of substantially uniformly shaped and sized ice cubes.

Another aspect of the present invention is that is may be manufactured economically.

Another aspect of the present invention is that it may be made from readily available materials.

These and other features and advantages of the present invention will be presented in more detail in the following specification of the invention and the accompanying figures, which illustrate by way of example the principles of the invention.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWING

The invention, together with further advantages thereof, may best be understood by reference to the following description taken in conjunction with the accompanying drawings in which.

DETAILED DESCRIPTION OF EMBODIMENTS OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known operations have not been described in detail so not to unnecessarily obscure the present invention.

Figure 1:
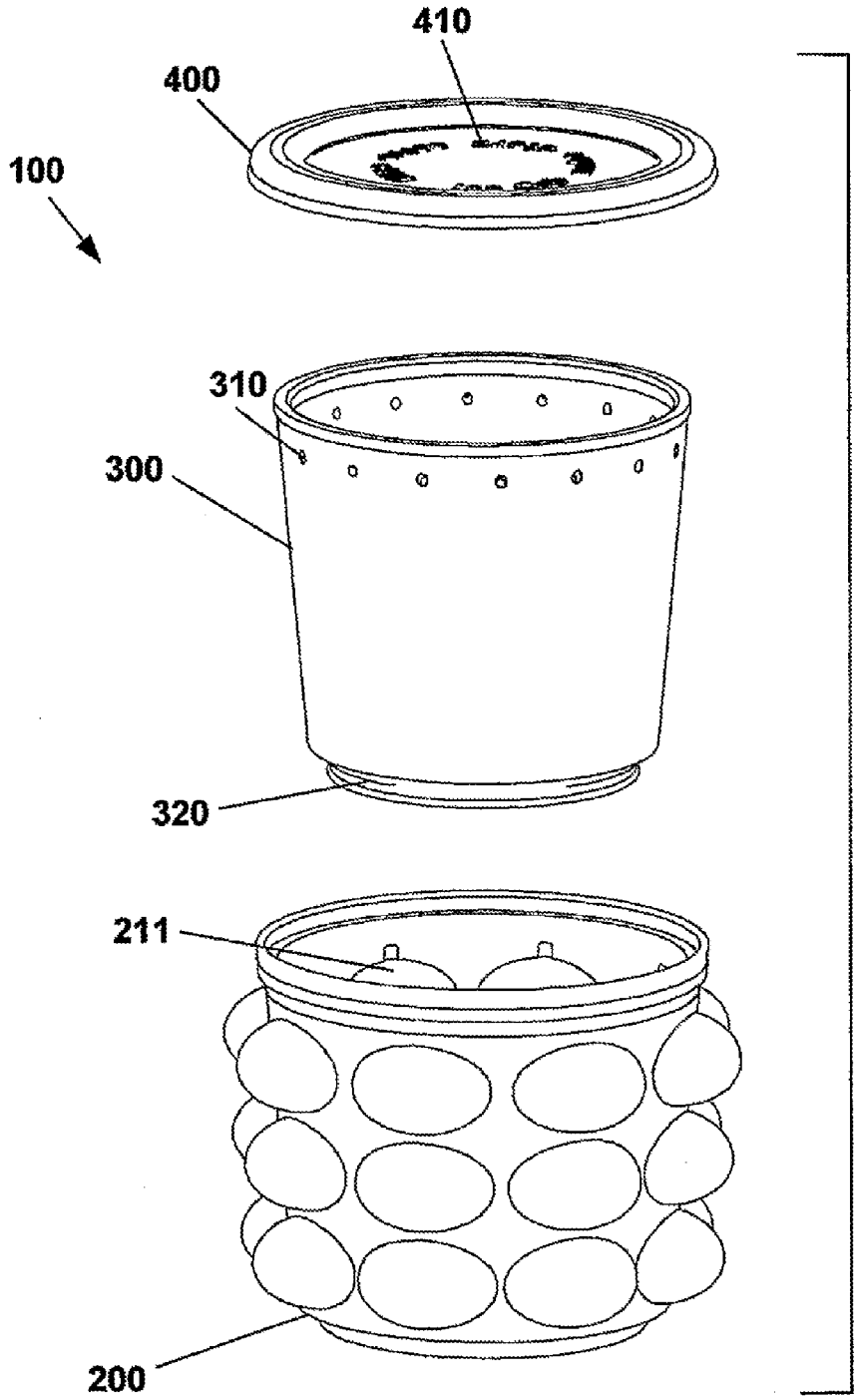
FIG. 1 illustrates an exploded perspective view of an ice holding device, according to an embodiment of the present invention.
Figure 2:
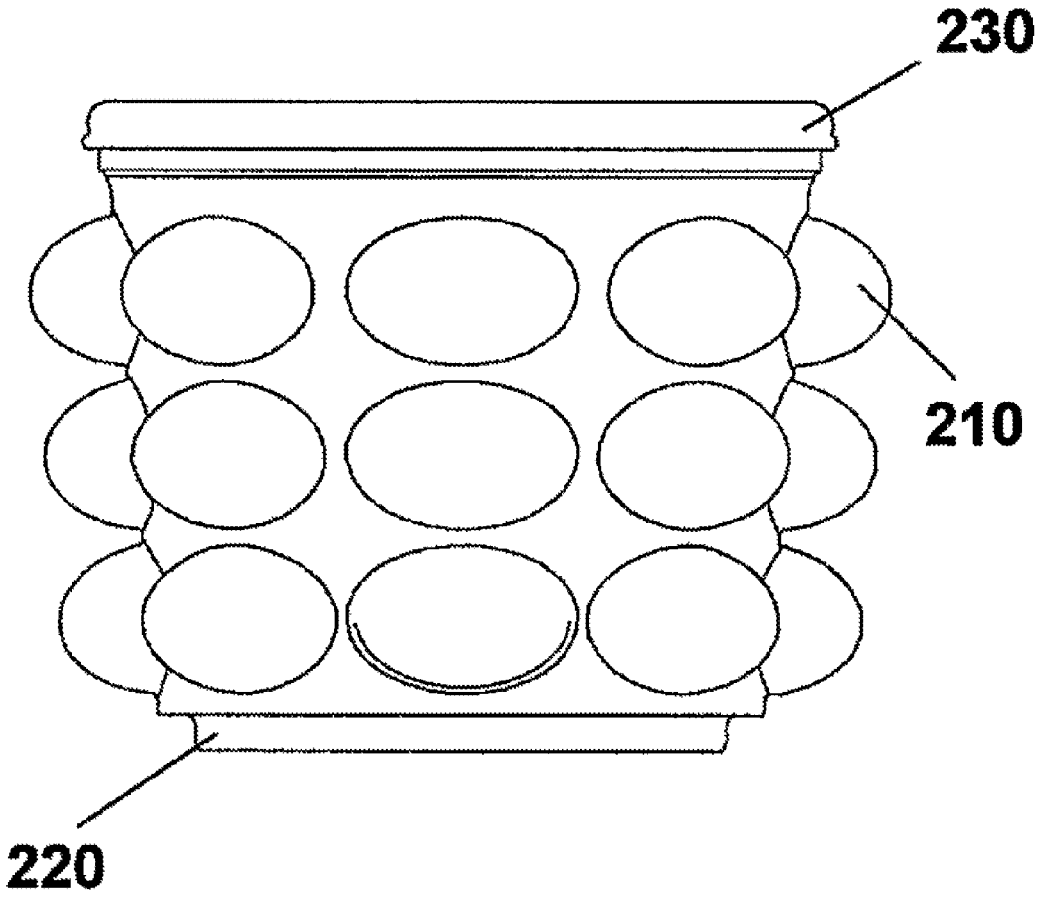
FIG. 2 illustrates a front plan view of an ice holding device, according to an embodiment of the present invention.
Figure 3:
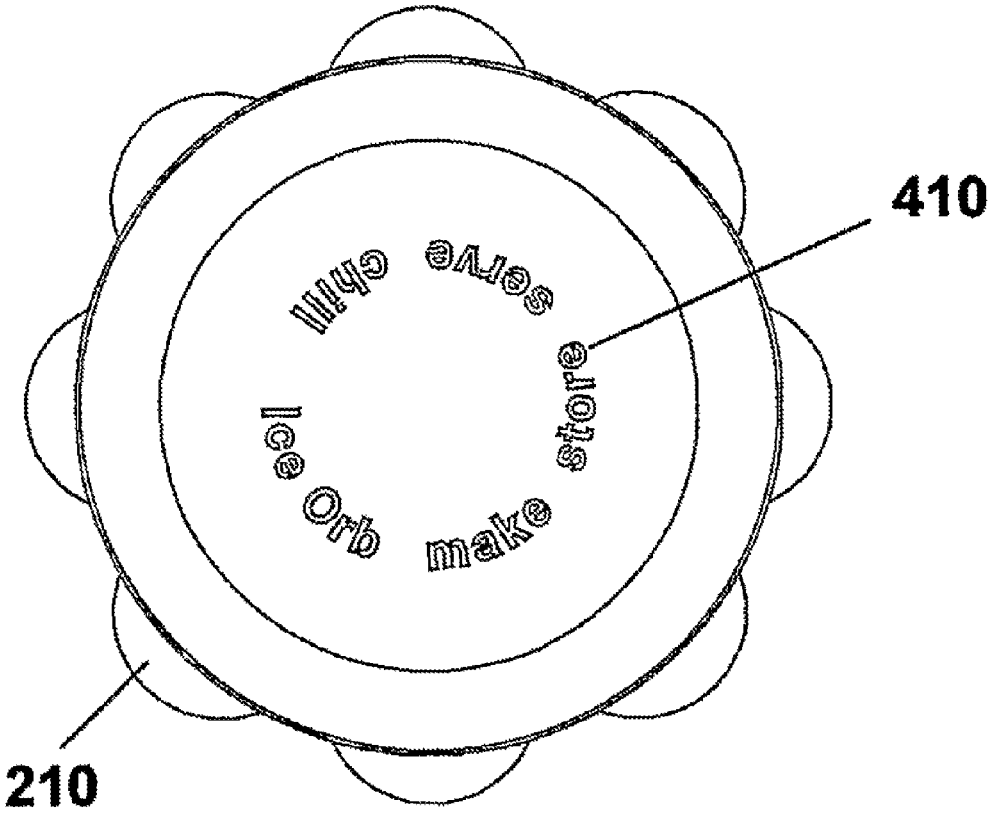
FIG. 3 illustrates a top plan view of an ice holding device, according to an embodiment of the present invention.
Figure 4:
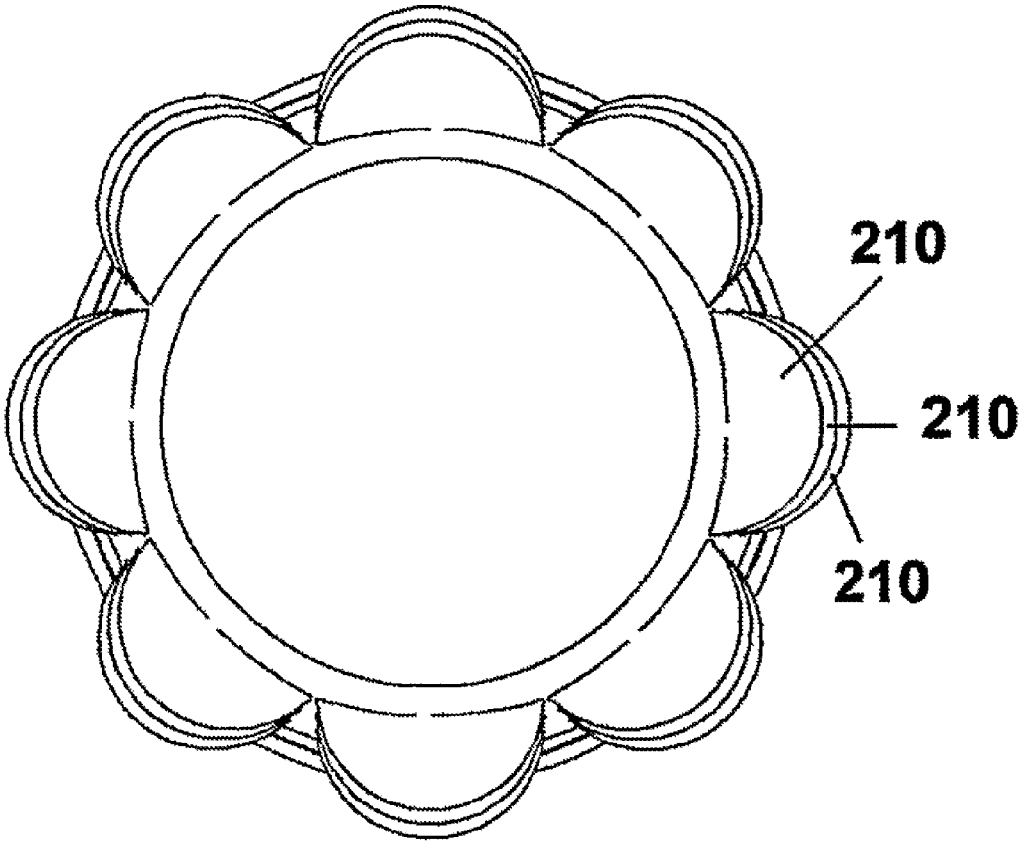
FIG. 4 illustrates a bottom plan view of an ice holding device, according to an embodiment of the present invention.

Referring now to FIG. 1 through FIG. 4 an exemplary embodiment of an ice holding device 100 is comprised of an external chamber 200, a damming bucket 300 and a lid 400. The exterior chamber 200 has an inside and an outside and is further comprised of an exterior chamber top 230 that is dimensioned to form an opening to the exterior chamber and an exterior chamber bottom 220. The exterior chamber 200 is further comprised of an array of cavities 211 formed on the inside of exterior chamber 200 where the indentions made by the formation of the array of cavities 211 form corresponding array of protrusions 210 on the outside of exterior chamber 200. The exterior chamber may be further comprised of a fill line or a fill indicator disposed on the inside of the exterior chamber 200.

In the exemplary embodiment of an ice holding device 100 the damming bucket 300 has an inside and an outside and is dimensioned and formed to fit snugly within the exterior chamber 200, such that a liquid that has been poured into the exterior chamber 200 to the fill line will be forced into the array of cavities. The damming bucket is further comprised of a damming bucket bottom 320 and an array of damming bucket holes 310 disposed towards the top of the damming bucket.

In the exemplary embodiment of an ice holding device 100, the lid 400 is dimensioned and formed to fit snugly on the exterior chamber top 230, either with the damming bucket 300 inserted or removed from the exterior chamber 200. The lid 400 has a top surface and a bottom surface. The top surface of the lid 400 has a message area 410.

In another embodiment a ice holding device is comprised of an external chamber, an internal bucket and a lid, where the external chamber has an external chamber bottom that is encompassed by an external chamber wall that has a first inside surface and a first outside surface thus forming an external chamber top opening. A fill indicator is clearly marked on the first inside surface. An array of cavities is formed within the first inside surface. This creates a corresponding array of protrusions emanating from the first outside surface. The internal bucket bottom is encompassed by an internal bucket wall that has a second inside surface and a second outside surface thus forming an internal bucket top opening. In this embodiment the second outside surface is substantially coplanar to the second inside surface.

In an alternate embodiment the inside wall of the external chamber is smooth and the internal bucket has an array of cavities formed within outside wall of the internal bucket where the array of cavities creates a corresponding array of protrusions within the internal bucket.

In one embodiment the present invention may be made as follows:

Cut or burn a shaped cavity into a mold that will create a compartment suitable for molding a part that will contain liquid Cut or burn another cavity that will create a part that will nest snuggly inside the other part Form surface protrusion features or surface indention features on one or both parts Fill the mold with silicone or other suitable material Remove the parts from the mold Cure the parts The device is now ready to be used From the foregoing, it will be appreciated that, although specific embodiments of the invention have been described herein for purposes of illustration, various modifications may be made without deviating from the spirit and scope of the invention. For example, many of the features and components described above in the context of a particular ice holding device configuration can be incorporated into other configurations in accordance with other embodiments of the invention. Accordingly, the invention is not limited except by the appended claims.

What is claimed is:

1. An ice holding device comprising:

an external chamber substantially cylindrically shaped and having an open top end and a closed chamber bottom end, wherein the external chamber is comprised of at least one side wall in communication with the closed chamber bottom end such that the interior surface of the at least one side wall and a top surface of the chamber bottom end define a volume;

an internal bucket having a single open end and a bucket bottom, wherein the internal bucket is comprised of at least one side wall in communication with the bucket bottom such that the interior surface of the at least one side wall and top surface of the bucket bottom operate to define a volume; and a lid;

wherein an array of individual cavities is formed in the interior surface of the at least one side wall of the external chamber such that a corresponding array of protrusions is formed on the exterior surface of the at least one side wall of the external chamber;

wherein the internal bucket is dimensioned such that, when inserted into said volume defined by the external chamber, the exterior surface of the at least one side wall of the internal bucket is juxtaposed with the interior surface of the at least one side wall of the external chamber;

wherein nesting of the internal bucket into said volume defined by the external chamber causes liquid placed within said external chamber volume to be displaced and forced into said array of individual cavities and further prevented from egress from the array of individual cavities by the exterior surface of the at least one side wall of the nested internal bucket;

wherein upon freezing the liquid, the contents of each individual cavity forms an individual solid element; and wherein the interior surface of the at least one side wall of the external chamber and exterior surface of the at least one side wall of the internal bucket are substantially coplanar.

* * * * *